United States Patent [19]

Salama

[11] 4,374,004

[45] Feb. 15, 1983

[54] METHOD AND APPARATUS FOR SURFACE-TREATING PREDETERMINED AREAS OF A SURFACE OF A BODY

[75] Inventor: Amir Salama, Cartierville, Canada

[73] Assignee: Northern Telecom Limited, Montreal, Canada

[21] Appl. No.: 278,744

[22] Filed: Jun. 29, 1981

[51] Int. Cl.[3] ..... C25D 5/02

[52] U.S. Cl. ..... 204/15

[58] Field of Search ..... 204/15, 224 R

[56] References Cited

U.S. PATENT DOCUMENTS

| | | | |
|---|---|---|---|
| 3,835,017 | 9/1974 | Mentone | 204/15 |
| 4,029,555 | 6/1977 | Tezuka | 204/15 |
| 4,186,062 | 1/1980 | Eidschun | 204/15 |

FOREIGN PATENT DOCUMENTS

| | | | |
|---|---|---|---|
| 1098182 | 1/1968 | United Kingdom | 204/15 |

OTHER PUBLICATIONS

IBM Technical Disclosure Bulletin, vol. 7, No. 9, Feb. 1965, p. 734.

*Primary Examiner*—T. Tufariello

*Attorney, Agent, or Firm*—Sidney T. Jelly

[57] ABSTRACT

A preselected area of a body is contacted with a surface treatment solution, ejected towards the body, areas of the body not to be treated being shielded by an inflatable member having a flexible surface which is moved into contact with the body. The invention is particularly useful for plating of rectangular cross-section terminal pins, a part of only one surface being plated. The inflatable member shields the back and side surfaces, only a front surface being contacted by the solution.

12 Claims, 9 Drawing Figures

METHOD AND APPARATUS FOR SURFACE-TREATING PREDETERMINED AREAS OF A SURFACE OF A BODY

This invention relates to the surface treatment of particular areas of a surface of a body and is particularly though not exclusively applicable to the plating of a particular area of a surface of a body, for example an area on a surface of a rectangular terminal pin.

The invention is of particular use in the plating of expensive metals, such as gold, on to contact members. Plating by immersion in a plating solution is used for many applications, plating occurring on all areas contacted by the solution. The process can be automated, and for relatively small objects and thin coatings, can be part of a manufacturing line. Plating can also be carried out by contacting a surface with a porous or filamentous member, such as a sponge or brush, to which solution is fed. Relative movement occurs between the spong or brush and the member being plated. However such methods are slow and not suitable for wall or restricted areas. It is also difficult to build into a manufacturing line as results are often variable.

The present invention provides for a method, and apparatus for, selectively contacting a predetermined area of body with a flow of liquid, while preventing contact with other areas. Particularly, a predetermined area is contacted by a solution by emitting the solution towards the body, and blanking off the area not to be plated by an inflatable member having a flexible surface which wraps round the body, leaving exposed only the area to be contacted by the solution. Control of solution emission will provide for further restriction of the area plated. Thus, as an example, one surface of a rectangular pin is plated by enveloping the pin or three sides leaving one side or surface exposed.

As stated, the invention is particularly useful in the gold plating of terminal pins, and other electrical contact means. Gold being very expensive, plating of surfaces not required to be plated, as in a pin making contact on only one surface, results in the use of more gold than necessary. By use of the invention there is a considerable reduction in costs. The process and apparatus can be part of a manufacturing line.

The invention will be readily understood by the following description of an embodiment of the invention, by way of example, in conjunction with the accompanying drawings, in which.

Figure 1:
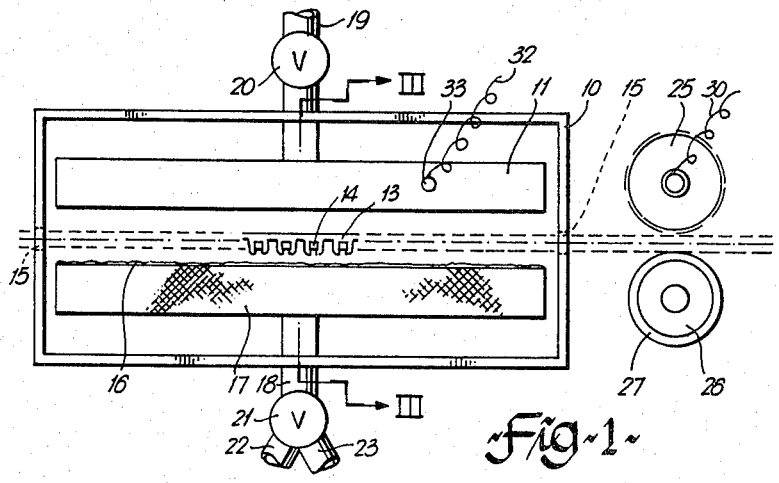
FIG. 1 is a top plan view of one form of apparatus for carrying out the invention, with the inflatable member deflated.
Figure 3:
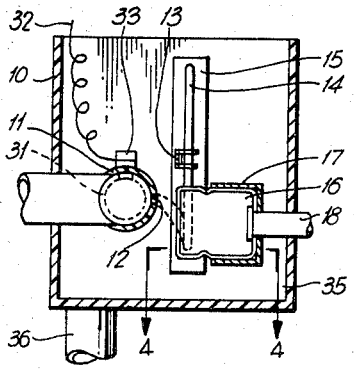
FIG. 3 is a cross-section on the line III—III of FIG. 1, but with the inflatable member inflated.

As illustrated in FIGS. 1 and 3, a tank 10, has a solution manifold 11. The manifold has a longitudinal slot or nozzle 12. A bandolier 13 carrying terminal pins 14 passes through the tank, entering and exiting the tank via apertures 15 at each end. The slot or nozzle faces toward the bandolier.

On the other side of the bandolier and pins is an inflatable member 16 retained in a housing 17, conveniently of gauze. Air, or other gas is fed to, and exhausted from, the inflatable member via a supply pipe 18. Solution is fed to the manifold 11 via a supply pipe 19, having a control valve 20. The gas flow to the inflatable member is controlled, for example by control valve 21, the valve either connecting the supply pipe 18 to a pressure supply pipe 22 or to an exhaust pipe 23. The exhaust can be at ambient or to a sub-atmospheric pump or chamber.

The bandolier 13 and pins 14 are moved through the tank by, for example, a wheel 25, which has teeth on the periphery for engagement with holes in the bandolier. A back-up wheel 26 with an elastomeric rim 27 is also provided. Similar wheels can be provided at the other end of the tank. For electro-plating, an electrical connector 30 can be connected to wheel 26, which is made electrically conducting. An anode is provided in the manifold 11, conveniently a gauze tube 31, as illustrated in FIG. 3. An electrical connection to a conductor 32 is made via a terminal 33.

Figure 2:
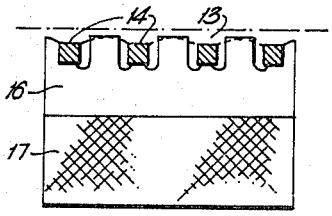
FIG. 2 is a view of part of FIG. 1 to a larger scale, with the inflatable member deflated.

In operation, a gas is fed to the inflatable member 16 when the bandolier is stationary and the front surface of the member wraps around the pins, as illustrated in FIG. 2, and in FIG. 3. The supply of solution is turned on and solution is emitted through the slot or nozzle 12 against the surfaces of the pins 14 facing the nozzle 12. The other surfaces of the pins are shielded from the solution by the inflatable member. The flow of solution, indicated at 35 is arranged to contact the surface of the pin for the length required. Solution drains from the tank via drain 36. After a predetermined time period the flow of solution is stopped, the inflatable member deflated, and then the bandolier and pins advanced to bring a fresh section into the tank.

Figure 4:
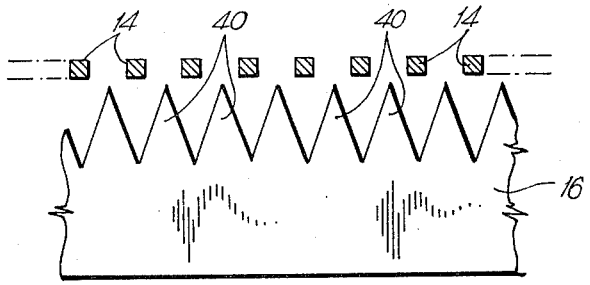
FIGS. 4 and 5 are views to a larger scale, of an alternative form of inflatable member, in the collapsed and inflated conditions, respectively generally on a plane as indicated by line IV—IV of FIG. 3.
Figure 5:
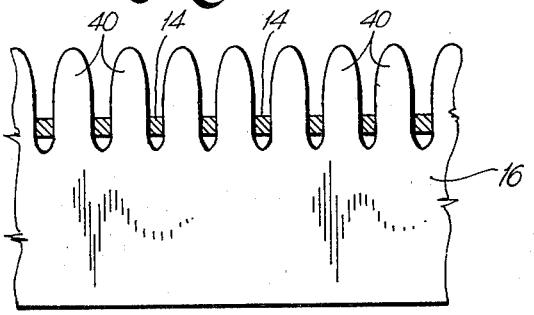

Various forms of inflatable member 16 can be provided. Thus while a single bag-like member can be used, particularly where relatively large items are to be shielded. For small, particular thin or narrow, members, for example the terminal pins 14, modifications to assist in penetration between the pins can give improved shielding. In FIG. 4, the inflatable member 16 has a front face which has a plurality of folds therein to create a plurality of Vee-shaped protrusions 40. On inflation of the member 16, the front face moves towards the pins 14, with the Vee-shaped protrusions passing between pins. The protrusions also change in cross-section slightly, expanding sideways and having a more curved cross-section. The sides of the pin are shielded against the solution, as is also the back surface. This is illustrated in FIG. 5.

Figure 6:
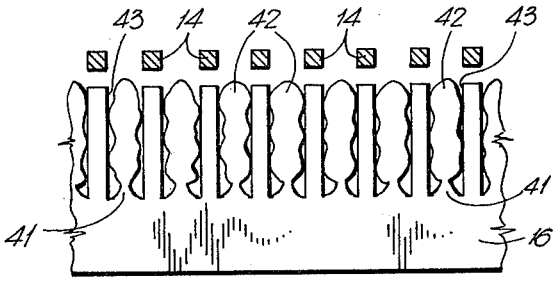
FIGS. 6 and 7 are views, similar to FIGS. 4 and 5, of a further form of inflatable member, in collapsed and inflated condition respectively.

FIG. 6 illustrates a further arrangement in which the inflatable member 16 has a plurality of small orifices 41 to which are attached individual balloon-like members 42. The members 42, when un-inflated are supported in compartments 43. On feeding of gas to member 16, the members 42 inflate and extend forward, from the compartments, between the pins 14. This shields both sides of a pin and the back. It is possible to arrange for the front wall of the member 16 to move forward, with the orifices 41 and members 42, as it is inflated, as with the example of FIGS. 4 and 5.

Figure 7:
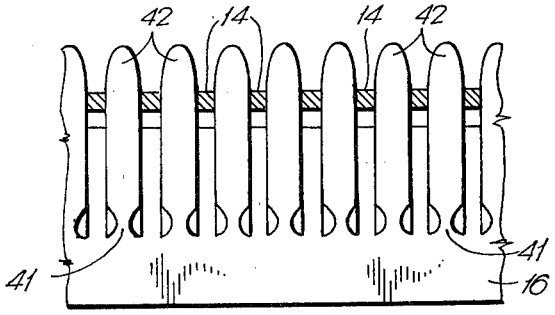

The material of the inflatable member 16 can vary. Depending upon the arrangement the thickness can be from about 0.001" to 0.004" when extreme flexibility is required, for example for the front surface in FIGS. 1 to 3, and in FIGS. 4 and 5. Also the ballon like members 42 in FIGS. 6 and 7 would be of such thin material. The rest of the inflatable member can be of thicker material, but in any case is generally supported in a perforated housing, as illustrated in FIGS. 1 and 3. The pressure to the inflatable member can also vary, depending upon flexibility of the inflatable member and the complexity of the shape being shielded. Typical pressures vary from 10 to 80 psi. The material can be natural or snythetic rubber, or other suitable elastomeric material, capable of withstanding the solution. As a further variation, only the front face, or the protrusions 40 and members 42 need be expandable by inflation, the rest of the member 16 being non-extensible.

Figure 8:
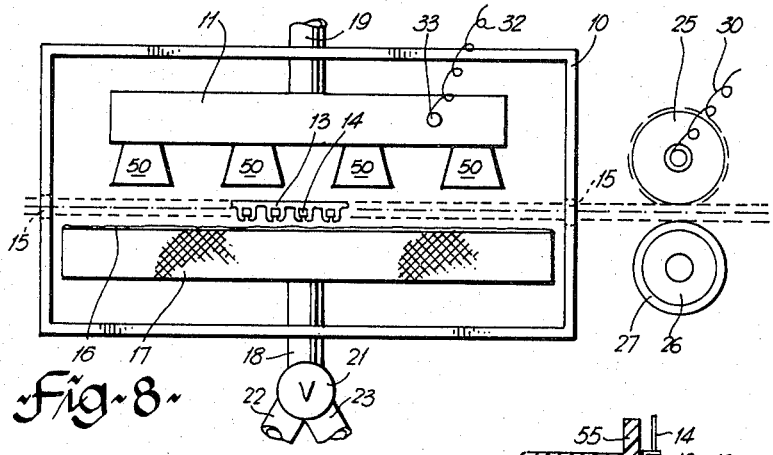
FIG. 8 is a similar view to that of FIG. 1, illustrating an alternative embodiment.

FIG. 8 illustrates an arrangement in which, instead of a continuous nozzle, as in FIGS. 1, 2 and 3, a plurality of separate nozzles 50. In other features, the arrangement is similar to that of FIGS. 1, 2 and 3 and the same reference numerals have been applied to the same items. The operation of the arrangement of FIG. 8 is the same as for FIGS. 1, 2 and 3.

Figure 9:
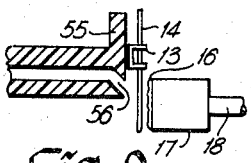
FIG. 9 illustrates an alternative nozzle structure.

FIG. 9 illustrates an alternative nozzle structure, in the form of a nozzle block 55, the nozzle indicated at 56. The nozzle block 55 will provide support for the pins 14, and bandolier 13, when the inflatable member 16 is inflated. The nozzle 56 is fed from a manifold or similar source of supply of solution.

The thickness of the plating will depend on various variables. Some typical values for electrolytically gold plating pins about 0.025" square are as follows. The length of the manifold 11 is from about eighteen to twenty-four inches, and the width of the solution nozzle about 0.2 inches. The pins are about 0.2–0.3 inches from the nozzles and the solution flow rate between approximately 1 and 5 gallons per minute. The pins are contacted with the solution for a period of approximately 15 to 30 seconds. The voltage is generally in the range of 5–10 volts at an about 0.5 to 1.0 amps. This gives a plating thickness of between about 50 to 70 microns. These values can be varied for different materials and different thicknesses of plating, for example.

Two different materials may need to be plated, for example nickel first and then gold. For this the necessary number of tanks can be arranged in series. Washing stations can be provided between plating tanks. For plating opposite surfaces of a square pin, two tanks can be used in series, plating first one side and then the other. Baffles may be provided in the tank to reduce spray. A cover can be positioned over the tank and a vent provided.

The process, and apparatus, can be used for electroless plating, in which case the anode 31 and electrical conectors 30 and 32 are not needed. The process, and apparatus, can also be used to apply liquids to predetermined areas, such as photoresist, plating resist, paint and other materials.

What is claimed is:

1. Apparatus for electroplating one surface of each of a plurality of spaced apart rectangular cross-section terminal pins, having front, back and side surfaces, comprising:

a tank;

means for supporting said pins in a predetermined position in said tank;

means for ejecting a plating solution towards the front surface of each pin;

an anode in the flow path of the plating solution, and means for supplying electrical power to said anode and to said pins;

an inflatable member in said tank positioned adjacent to the rear surfaces of the pins, said inflatable member having a thin flexible, extensible, front surface of elastomeric material for contacting the back and side surfaces of the pins;

means for feeding an inflation gas to said inflatable member;

said flexible front surface extended on inflation of said inflatable member to wrap around said pins in contact with the back and side surfaces of the pins, to expose only the front surfaces of the pins to the plating solution.

2. Apparatus as claimed in claim 1, said means for ejecting a surface treatment solution comprising at least one elongate nozzle.

3. Apparatus as claimed in claim 1, for electroplating a surface of a plurality of terminal pins, spaced apart, said flexible front surface of said inflatable member comprising a plurality of hollow protrusions, in communication with the interior of said inflatable member, said protrusions extending between pins on inflation of said inflatable member.

4. Apparatus as claimed in claim 3, said protrusions comprising a plurality of ballon-like inflatable members.

5. Apparatus as claimed in claim 1, including means for moving said pins in a vertical array, stepwise through said tank; said means for ejecting a plating solution comprising a manifold positioned in opposition to said front surface of each pin; means for supplying a controlled flow of plating solution to said manifold, said manifold including at least one nozzle facing towards said front surfaces of the pins; and control means to inflate said inflatable member when pins are stationary and to move pins when said inflatable member is deflated.

6. Apparatus as claimed in claim 5, including a nozzle extending substantially for the length of the manifold, said nozzle being a slot in the periphery of the manifold.

7. Apparatus as claimed in claim 5, including a plurality of nozzles spaced apart along the manifold.

8. Apparatus as claimed in claim 5, including a nozzle block, said nozzle formed in said nozzle block, said nozzle block acting to support said pins when said inflatable member is inflated.

9. Apparatus as claimed in claim 5, for plating pins held in a bandolier, said means for moving said pins comprising at least one pair of wheels engaging with said pins and bandolier, electrical power applied to said pins by at least one of said wheels.

10. Apparatus as claimed in claim 5, for gold plating, said anode comprising gold gauze.

11. A method of electroplating one surface of each of a plurality of spaced apart rectangular section terminal pins, having front, back and side surfaces, comprising;

supporting the pins in a predetermined position in a tank;

ejecting a plating solution towards the front surface of each pin, the solution flowing over an anode;

applying electrical power to said anode and said pins;

inflating an inflatable member having a thin flexible, extensible front surface of elastomeric material against the rear surfaces of the pins, the front surface of the inflatable member passing between the pins to contact the side surfaces of the pins, the side and rear surfaces of the pins being shielded against said plating solution.

12. A method as claimed in claim 11, for plating a plurality of pins carried in a bandolier, including moving said pins stepwise, and inflating said inflatable member when the pins are stationary, and moving the pins when the inflatable member is deflated.

* * * * *